US010640352B2

(12) United States Patent
Gourand

(10) Patent No.: US 10,640,352 B2
(45) Date of Patent: May 5, 2020

(54) CORKSCREW WITH LEVER

(71) Applicant: PSP, Quingey (FR)

(72) Inventor: Thierry Gourand, Bans (FR)

(73) Assignee: PSP, Quingey (FR)

( * ) Notice: Subject to any disclaimer, the term of this patent is extended or adjusted under 35 U.S.C. 154(b) by 12 days.

(21) Appl. No.: 15/779,523

(22) PCT Filed: Oct. 21, 2016

(86) PCT No.: PCT/FR2016/052719
§ 371 (c)(1),
(2) Date: May 27, 2018

(87) PCT Pub. No.: WO2017/093623
PCT Pub. Date: Jun. 8, 2017

(65) Prior Publication Data

US 2018/0346304 A1 Dec. 6, 2018

(30) Foreign Application Priority Data

Nov. 30, 2015 (FR) ..... 15 61546

(51) Int. Cl.
*B67B 7/04* (2006.01)

(52) U.S. Cl.
CPC ..... *B67B 7/0429* (2013.01); *B67B 7/0423* (2013.01)

(58) Field of Classification Search
CPC ..... B67B 7/0429; B67B 7/0423; B67B 2007/0494; B67B 7/44; B67B 2007/0458;
(Continued)

(56) References Cited

U.S. PATENT DOCUMENTS 6,101,900 A * 8/2000 Traspuesto Miguel ..... B67B 7/0429 81/3.09
6,116,116 A * 9/2000 Brucart Puig ..... B67B 7/0429 81/3.09

(Continued)

FOREIGN PATENT DOCUMENTS

EP 0143475 A2 6/1985
EP 0860396 A1 8/1998

(Continued)

*Primary Examiner* — Orlando E Aviles
*Assistant Examiner* — Robert F Neibaur
(74) *Attorney, Agent, or Firm* — Craft Chu PLLC; Andrew W. Chu

(57) ABSTRACT

The corkscrew with lever includes a spiral mounted rotating on a zone of a handle between an end segment and a maneuvering segment, and a telescoping arm having a first element mounted rotating on the end segment and a second element, having an upper end and a lower end, mounted sliding in the first element between an idle position and a second position. The lower edge of the lower end of said second element is provided to bear on the neck of a bottle. The end segment defines a circular cam having, as center, the second axis and able to act on the upper end of the second element, which is connected to the second axis using a return member. In a usage position of the corkscrew, its upper end is continuously kept in contact with the cam and its lower end extends continuously outside the first element.

10 Claims, 6 Drawing Sheets

(58) Field of Classification Search
CPC ... B67B 2007/047; B67B 7/04; B67B 7/0441; B67B 7/16; B25B 27/02; B25B 27/04; B25B 27/06; B25B 31/00; B25B 33/00
USPC ..... 81/3.47, 3.09, 3.35, 3.55; 7/152, 155, 7/154, 151, 156
See application file for complete search history.

(56) References Cited

U.S. PATENT DOCUMENTS

| | | | | |
|---|---|---|---|---|
| 6,367,353 | B2 * | 4/2002 | Brucart Puig | B67B 7/0429 81/3.36 |
| 6,397,704 | B1 * | 6/2002 | Olaneta | B67B 7/0429 81/3.09 |
| 7,437,973 | B2 * | 10/2008 | Cellini | B67B 7/0429 81/3.36 |

FOREIGN PATENT DOCUMENTS

| | | | | |
|---|---|---|---|---|
| FR | 2755957 | A1 | 5/1998 | |
| FR | 2772364 | A1 | 6/1999 | |
| GB | 2091227 | * | 7/1982 | B67B 7/04 |
| NL | 1024791 | C2 | 5/2005 | |
| WO | 2005075337 | A1 | 8/2005 | |

* cited by examiner

CORKSCREW WITH LEVER

CROSS-REFERENCE TO RELATED APPLICATIONS

See Application Data Sheet.

STATEMENT REGARDING FEDERALLY SPONSORED RESEARCH OR DEVELOPMENT

Not applicable.

THE NAMES OF PARTIES TO A JOINT RESEARCH AGREEMENT

Not applicable.

INCORPORATION-BY-REFERENCE OF MATERIAL SUBMITTED ON A COMPACT DISC OR AS A TEXT FILE VIA THE OFFICE ELECTRONIC FILING SYSTEM (EFS-WEB)

Not applicable.

STATEMENT REGARDING PRIOR DISCLOSURES BY THE INVENTOR OR A JOINT INVENTOR

Not applicable.

BACKGROUND OF THE INVENTION

1. Field of the Invention

The invention relates to a corkscrew of the type "with lever" including, on the one hand, a spiral mounted rotating on a zone of a handle comprised between an end segment and a maneuvering segment of said handle, around a first axis perpendicular to said sleeve, and on the other hand, a telescoping arm having a first element mounted rotating on the end segment of said handle around a second axis perpendicular to said handle and a second element, having an upper end and a lower end, mounted sliding in said first element between an idle position in which its lower end is located at a distance d0 from said second axis and a second position in which its lower end is located at a distance d from said second axis greater than d0, the lower end of said second element being provided able to bear on the neck of a bottle.

2. Description of Related Art Including Information Disclosed Under 37 CFR 1.97 and 37 CFR 1.98

A corkscrew of the type "with lever" traditionally makes it possible to reduce the pulling force that a user must supply to remove a cork after having inserted a spiral therein.

Different categories of corkscrews of this type are currently commercially available, in particular differing from one another by the number of bearings or the number of levers that they include.

The most basic model includes a lever with a fixed length allowing a single bearing on the neck. Such a device nevertheless has limitations at the end of uncorking, when the force to be exerted to remove the cork becomes significant, or in case of cork with a length greater than the standard length. Indeed, the handle of the corkscrew is then placed practically vertically relative to the bottle, and the lever can no longer act, requiring the user to complete the uncorking operation without using it.

Other, more elaborate models have been proposed to offset this drawback.

A corkscrew model is thus known including two separate levers fastened on the same rotation axis and each having a bearing point on the neck of a bottle. Such a structure nevertheless results in a somewhat tedious usage mode, since it requires the user to change the bearing point, and therefore lever point, during the operation. Furthermore, after placing the second lever, it is necessary to pivot the first lever to place it in a position in which it does not risk hindering the operation thereof or bothering the user.

A corkscrew with double bearing has also been considered, having a first lever, including a first bearing, fastened on the handle of the corkscrew, and a second lever, having a second bearing, mounted rotating on the lower end of the first lever. In the same category is also a corkscrew with double bearing described in document FR 2,755,957, which includes a first lever mounted pivoting on the handle and a second lever smaller than the first lever mounted rotating on a central part of the latter. Nevertheless, such corkscrews do not make it possible to resolve the drawbacks mentioned above, since here again, their structure is such that the user is forced to change levers during uncorking, and to pivot one and/or the other of the two levers in order to put it in the usage and idle position.

Furthermore, a corkscrew is also known with a single lever and multiple bearings as described in publication FR 2,772,364, in which the different bearing points are embodied by a row of notches made in a groove of the lever. Such a structure also involves manually changing the bearing point as a cork is removed. Consequently, it is no more satisfactory, in terms of its usage comfort, than the solutions described above.

Document EP 0,860,396 describes another solution in which the corkscrew includes a lever having a first element with a given length connected to the handle and the lower end of which is provided with a bearing point. The lever also has a second element connected to the first element, the lower end of which is also provided with a bearing point and which is movable between a position retracted inside the first element and a position partially removed from the first element. In its retracted position, the upper edge of the second element appears in a window formed in the front face of the first element and in which the head of the handle is able to be inserted during its rotational movement. The movement of the second element toward its position partially removed from the first element results in lengthening the latter. This movement is obtained by the action of the handle being gradually inserted, following its rotation, into the window of the first element and therefore bearing on the upper edge of said second element. Such a structure makes it possible to simplify the implementation of the corkscrew, because there is no longer a need to replace one lever with another or one bearing point with another during the removal of the cork. Nevertheless, it has been observed that the length by which the first element is extended is generally not sufficient to allow the removal of the entire cork using the lever and that the user must generally use his strength alone to ultimately achieve this.

BRIEF SUMMARY OF THE INVENTION

The present invention aims to offset the aforementioned drawbacks and to propose a solution allowing a user to remove, easily and successfully with each attempt, a cork held in the neck of a bottle. In particular, the invention aims to facilitate the uncorking of bottles by a user using a corkscrew of the type "with lever" making it possible to retain the simplicity of the single bearing, while reducing the force necessary for uncorking and retaining the interest of the corkscrew with multiple bearings, i.e., a different separation of the bearing lever relative to its rotation axis on the handle of the corkscrew depending on the level of insertion of the cork into the bottle. Additionally, the invention also aims to propose a solution making it possible to reduce the number of steps necessary for folding/unfolding of the spiral and the lever, by ensuring that these elements can fold/unfold simultaneously through a single gesture by the user.

To that end, the present invention relates to a corkscrew of the type indicated in the preamble, characterized in that the end segment of said handle is configured so as to define a circular cam having, as center, said second axis and able to act on the upper end of said second element, which is connected to said second axis using a return member such that, in a usage position of the corkscrew, its upper end is continuously kept in contact with said cam and its lower end extends continuously outside said first element.

Other features and advantages of the invention will emerge from the following detailed description relative to one embodiment of the ejection device given solely for information and non-limitingly.

BRIEF DESCRIPTION OF THE SEVERAL VIEWS OF THE DRAWINGS

The understanding of this description will be facilitated in reference to the attached drawings.

DETAILED DESCRIPTION OF THE INVENTION

It is first specified that in the following description, the arrows E and m shown in some figures respectively represent the forces applied by a user on a component element of the corkscrew 1 according to the invention, and the movement imparted by these forces.

Figure 1:
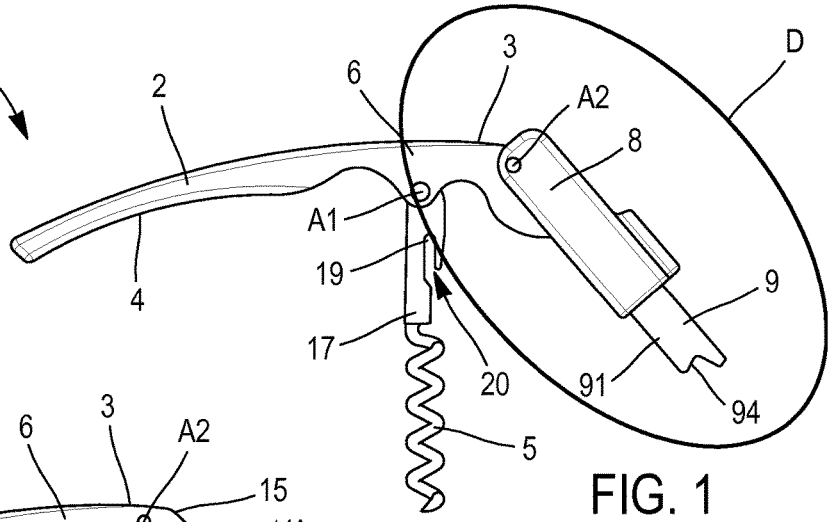
FIG. 1 shows a front elevation view of a corkscrew according to the invention in its usage position in which the spiral and the arms are unfolded.
Figure 2:
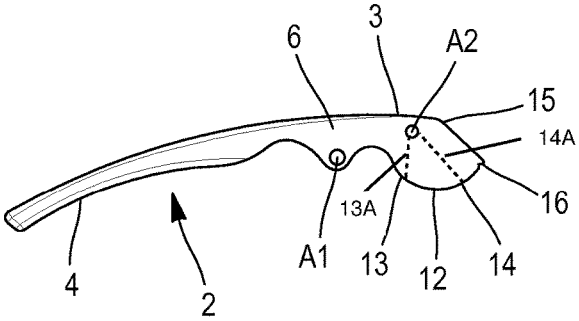
FIG. 2 is a front elevation view of the handle of the corkscrew of FIG. 1.
Figure 12:
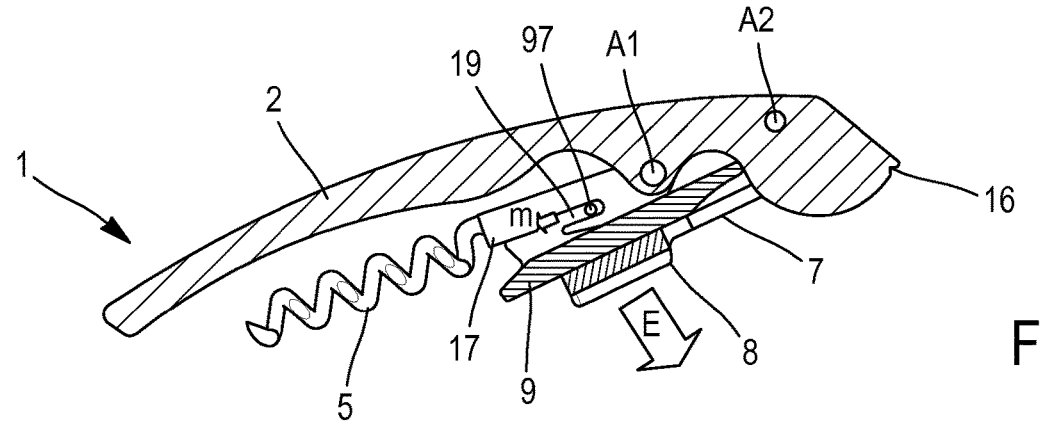
FIGS. 12 to 14 are sectional views of the corkscrew of FIG. 1 during different steps of its unfolding.

In the alternative embodiment illustrated in the figures, the corkscrew 1 according to the invention includes a handle 2, for example made from wood, metal, plastic, composite material, ceramic or any other equivalent material, having an end segment 3 and a maneuvering segment 4. A metal spiral 5 is mounted rotating around the first axis A1 perpendicular to the handle 2 over an intermediate zone 6 of said handle 2 comprised between its end segment 3 and its maneuvering segment 4. The corkscrew 1 also includes a telescoping arm 7, made from metal, mounted rotating on the end segment 3 of said handle 2 around a second axis A2 perpendicular to said handle 2. Thus, traditionally, the spiral 5 and the telescoping arm 7 are movable between a usage position of the corkscrew 1, in which they are unfolded (FIG. 1), and a storage position of the corkscrew 1, in which they are folded against the lower edge of the handle 2 (FIG. 12).

Figure 5:
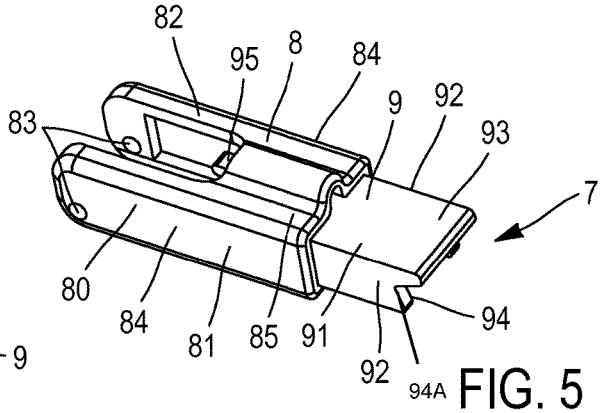
FIG. 5 is a perspective view of the arm of the corkscrew of FIG. 1.
Figure 6B:
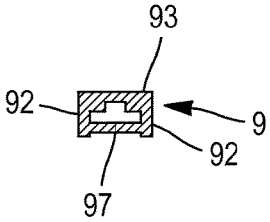
FIG. 6B is a sectional view across line CC of the second element of this same arm.
Figure 6:
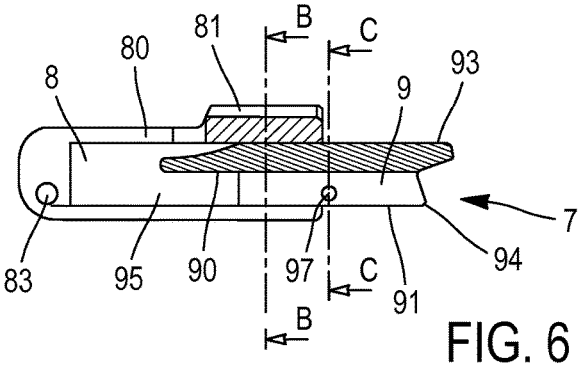
FIG. 6 is a sectional view across line AA of this same arm.

In reference to FIGS. 5 and 6, the telescoping arm 7 is made up of a first element 8 having an upper part 80 and a lower part 81 and a second element 9, having an upper end 90 and a lower end 91. The lower part 81 of the first element 8 has a C-shaped section and has two L-shaped side walls 84 bordering a face 85. The upper part 80 of the first element 8 includes two tabs 82 extending each of the side walls 84 of the lower part and the respective free end of which includes an orifice 83 allowing the assembly of the telescoping arm 7 on the axis A2 of the handle 2.

The second element 9 of the telescoping arm 7 has an upper end 90 and a lower end 91. It includes two side fins 92 bordering a bottom 93 and with the second element 9 being a generally U-shaped section. The lower edge 94 of each of the lateral wings 92 has a V-shaped cutout 94A able to bear on the neck 11 of a bottle, for which it forms a substantially complementary shape. Furthermore, its upper end 90 includes two teeth 95 extending in the extension of the bottom 93 and side wings 92. According to the invention, the second element 9 further includes an axis or side axis 97 extending between its side wings 92 at its lower end 91.

Figure 7:
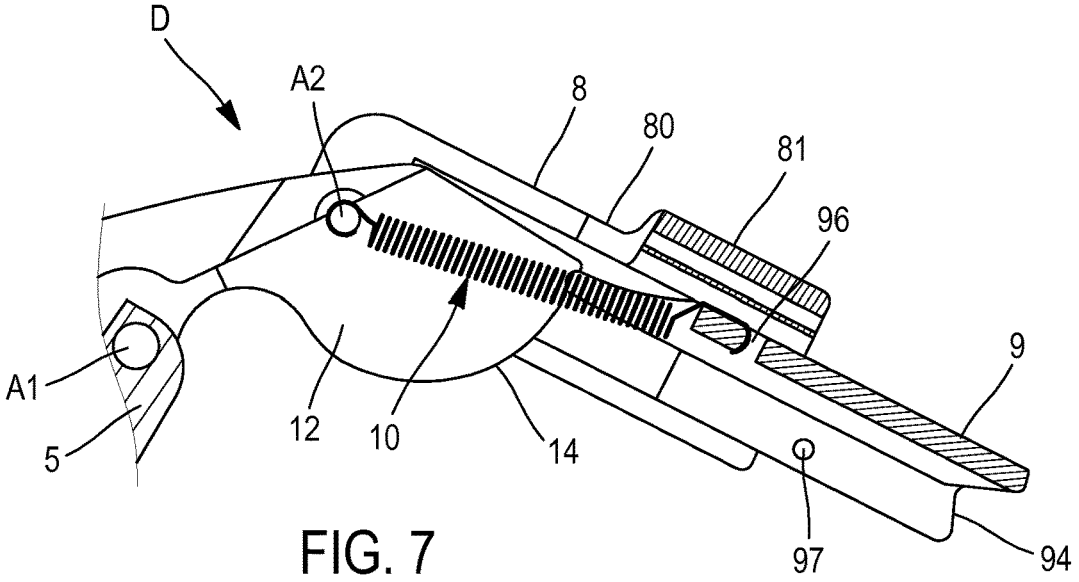
FIG. 7 is a sectional view of detail D of FIG. 1.

According to the invention, the second element 9 is mounted sliding in the first element 8, the side walls 84 of which define a guideway. The second element 9 is also connected to the second axis A2 of the telescoping arm 7 using an extension spring, for example a helical spring 10 (cf. FIG. 7), a first end of which is fastened to said axis A2 and a second end of which is fastened on the element 9, for example in a notch 96 included by the bottom 93 of the latter. According to another alternative embodiment that is not shown, it is also possible to provide for equipping the element 9 with an axis mounted between its surfaces 92 and on which the second end of the spring 10 can be fastened. In this case, said axis may be mounted sliding in an oblong aperture formed appropriately on a wall 84 of the element 8, and advantageously defining a maximal travel of the element 9 making it possible to avoid any untimely disassembly of the element 7 by pulling.

It should be noted that the second element 9 is mounted in the first element 8 and connected to the handle 2 using the spring 10 such that, in the usage position of the corkscrew 1, its teeth 95 are continuously kept in contact with the lower edge of the end segment 3 of the handle 2, while its lower end 91 is continuously located outside the first element 8. The stops 26 included by the first element 8 also contribute to keeping the lower end 91 of the second element 9 outside the first element 8.

Figure 3:
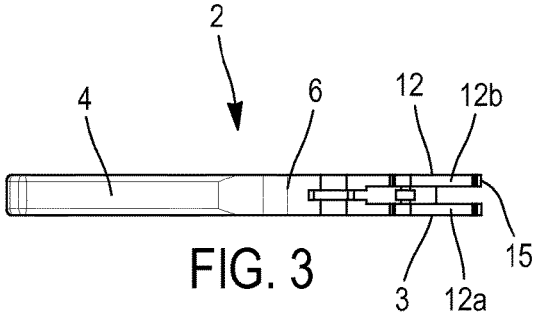
FIG. 3 is a bottom plan view of this same handle.
Figure 6A:
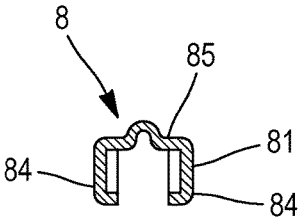
FIG. 6A is a sectional view across line BB of the first element of this same arm.
Figure 11:
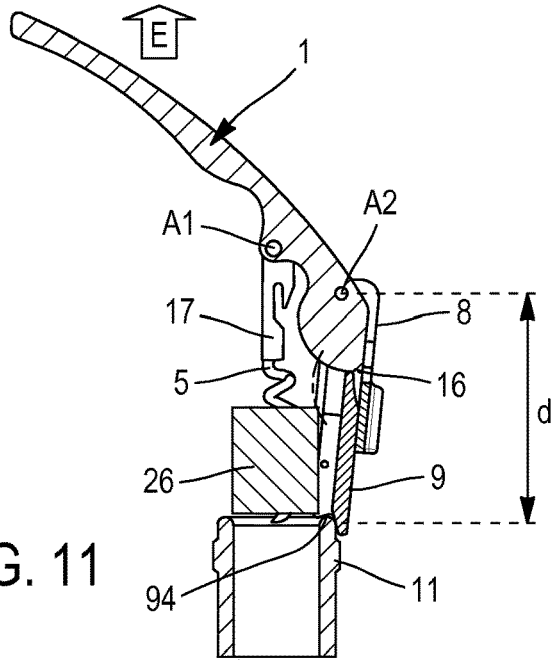

Indeed, in reference to the figures, the end segment 3 of the handle 2 defines a circular cam 12 having, as center, the second rotation axis A2. The invention provides that the profile of this cam 12 includes a first curve 13 with a constant radius 13A and a second curve 14 with an increasing radius 14A following one another between the intermediate zone 6 of the handle 2 bearing the first axis A1 and the end edge 15 of the end segment 3 of the handle 2. The circular cam 12 further includes a stop 16 formed in the extension of the curve of increasing radius 14. In fact, in the illustrated alternative embodiment, the circular cam 12 has two symmetrical members 12*a*, 12*b* (cf. FIG. 3) each in contact with a tooth 95 of the second element 9 of the telescoping arm 7. Thus, the cam 12 is able to act on the upper end 90 of the second element 9 in order to move the latter between an idle position which its lower edge 94 is located at a first distance or distance d0 from the second axis A2 and a second position in which the lower edge 94 is located at a second distance or distance d from the second axis A2 greater than d0 (cf. FIGS. 9 and 11).

Figure 4:
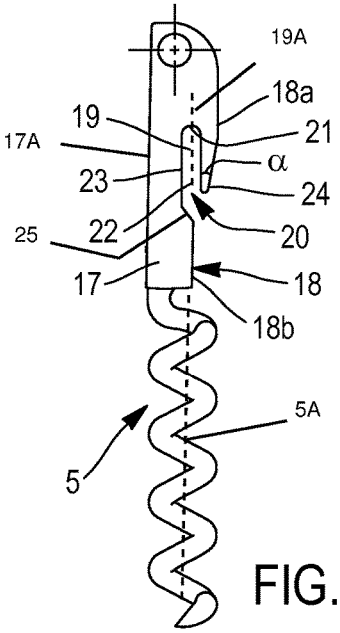
FIG. 4 shows a front elevation view of the spiral of the corkscrew of figure
Figure 8:
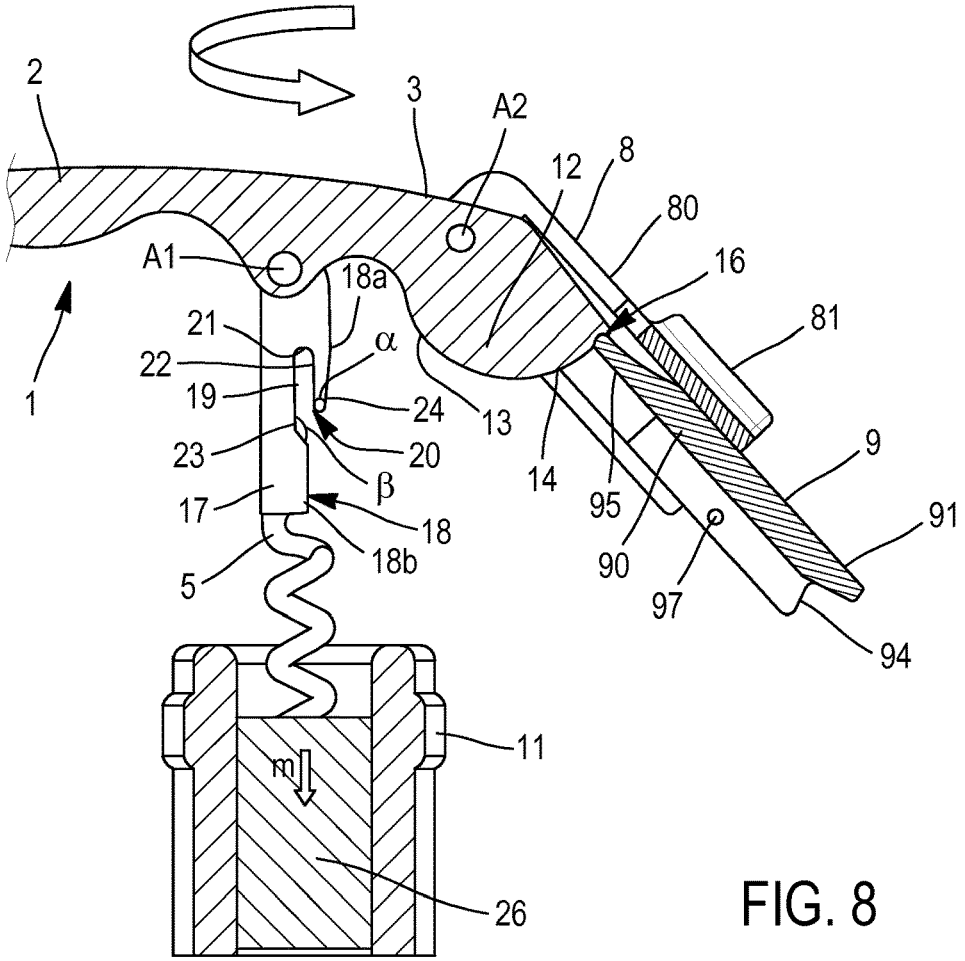
FIGS. 8 to 11 show sectional views of the corkscrew of FIG. 1 and the neck of a bottle during different steps of the uncorking of the latter.

The spiral 5 traditionally includes an upper part 17 with a rectangular section 17A connected to the first axis Al of the sleeve 2. It has a side face 18 (cf. FIGS. 4 and 8) oriented toward the telescoping arm 7. According to the invention, the upper part 17 is provided with a groove 19 with an axis or groove axis 19A parallel to the longitudinal axis 5A of the spiral 5, and the inlet opening 20 of which is formed in its side face 18, dividing the latter into an upper zone 18*a* and a lower zone 18*b*. More particularly, in the illustrated alternative embodiment, the groove 19 has a U-shaped section and includes a bottom 21 delimited by a front wall 22 and a rear wall 23. The groove 19 is provided able to accommodate the axis 97 included by the second element 9 of the telescoping arm 7 in the storage position of the corkscrew 1. Furthermore, the front wall 22 is connected to the upper zone 18*a* of the side face 18 by an oblique surface 24 forming, with said front wall 22, an angle $\alpha$ smaller than 90°. The rear wall 23 of the groove 19 is in turn connected to the lower zone 18*b* of the side face 18 by another oblique surface 25 forming, with said rear wall 23, an angle $\beta$ greater than 90° (cf. FIG. 8).

The particular structure of the upper part 17 of the spiral 5 and the presence of the axis 97 on the second element 9 of the telescoping arm 7 advantageously allow concomitant folding/unfolding of the spiral 5 and the arm 7. Indeed, the deployment/folding of the telescoping arm 7, obtained after its rotation around the axis A2 in one direction or the other, drives the movement of the spiral 5.

Figure 13:
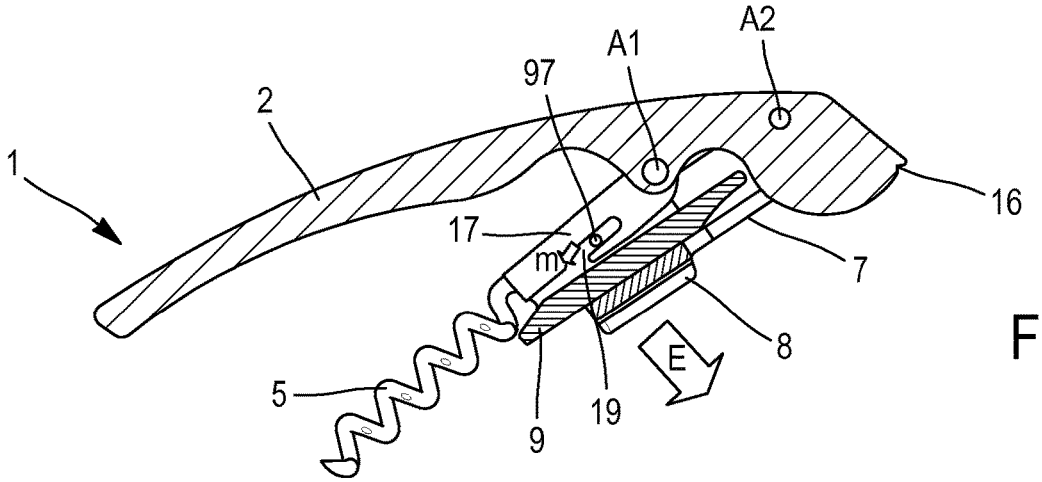
Figure 14:
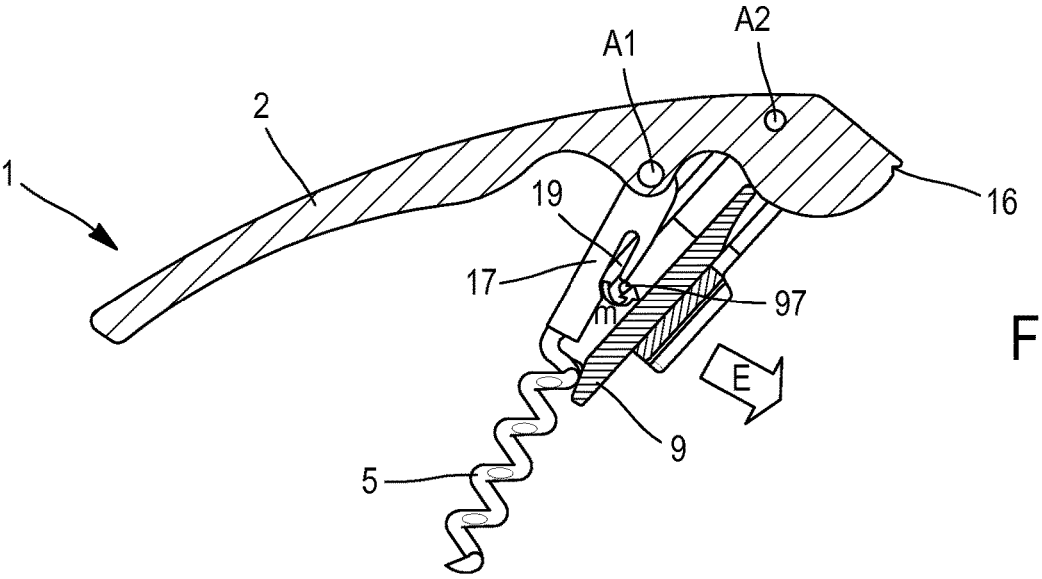

Thus, to unfold the spiral 5 and the arm 7, the user needs only pull on the arm 7 to deploy it (cf. FIG. 12). The axis 97 of the second element 9 of the arm 7 then slides in the groove 19 of the upper part 17 of the spiral 5, while bearing on the front wall 22 of said groove 19. This results in driving the spiral 5 gradually in the rotational movement of the telescoping arm 7 (cf. FIGS. 13-14). When the axis 97 of the second element 9 of the arm 7 reaches the inlet opening 20 of the groove 19, the spiral 5 is released from its contact with the arm 7 and places itself in the active, completely unfolded position owing to the action of the spring (not shown) connecting it 97 to the handle 2. Furthermore, at the end of deployment, the teeth 95 of the second element 9 of the arm 7 are placed in contact with the cam 12 of the handle 2, against the stop 16 (cf. FIG. 1).

In this position of the corkscrew 1, the user can then screw the spiral 5 into a cork 26 closing the neck 11 of a bottle by rotating the entire corkscrew 1 around the longitudinal axis of the spiral 5. The arm 7 advantageously remains blocked against the stop 16 throughout this entire operation under the effect of the force exerted by the user on the handle 2 (cf. FIG. 8) and therefore does not risk hindering the movements of the latter.

Figure 9:
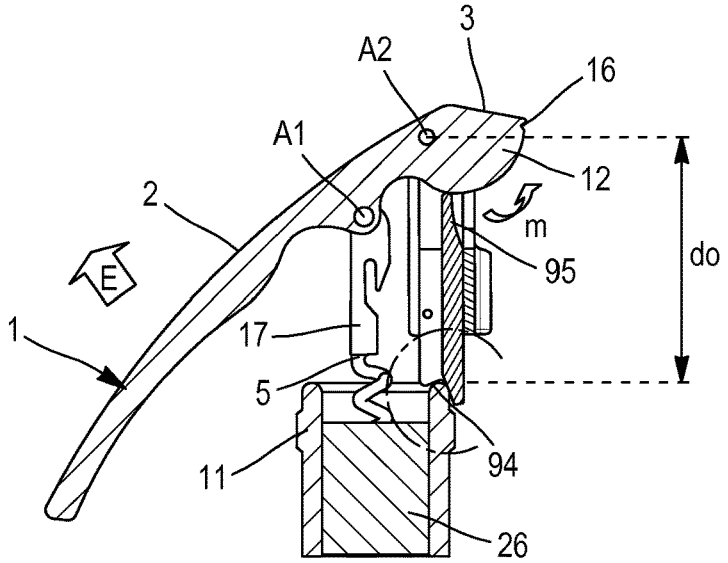

Owing to the invention, the user can next remove the cork 26 from the neck 11 with a reduced force. To that end, he first frees the telescoping arm 7 blocked against the stop 16 of the cam 12 of the handle 2 by pushing the maneuvering segment 4 of the latter downward toward the neck 11. He next positions the V-shaped lower edge 94 of the second part 9 of the telescoping arm 7 on the neck 11 of the bottle, which will allow him to bear on the latter subsequently. The position of the corkscrew 1 then obtained is illustrated in FIG. 9.

Figure 10:
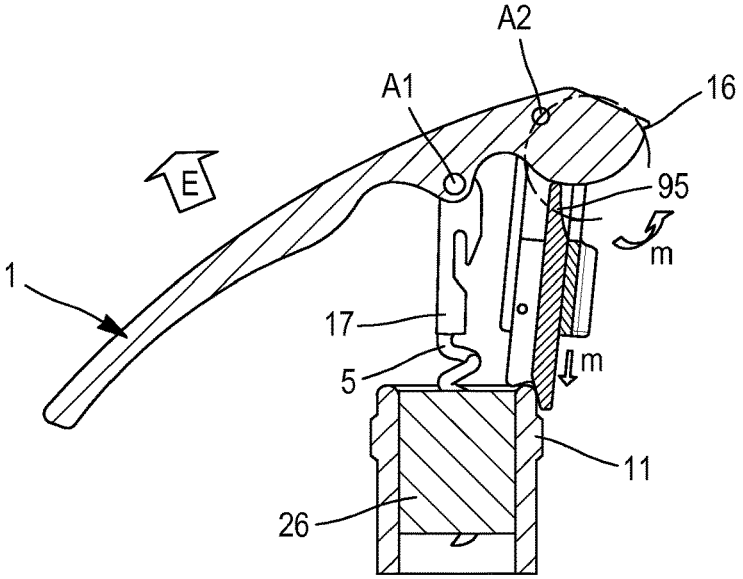

Through an upward pulling force on the maneuvering segment 4 of the handle 2, the user next removes the cork 26 gradually from the neck 11 in a single movement. The pulling force exerted then causes the arm 7 and the spiral 5 to rotate around their respective rotation axes A1, A2. The second part 9 of the arm 7, the teeth 95 of which are continuously kept in contact with the profile of the cam 12, under the effect of the spring 10, follows the rotational movement of the arm 7 during a first phase of the movement, its teeth 95 then being subject to the action of the first curve 13 with a constant radius of the cam 12 (cf. FIG. 10). Then, during the second phase of the removal movement, the teeth 95 of the second part 9 of the arm 7 come into contact with the second curve 14 with an increasing radius of the cam 12. The latter then bears on said second element 9 until causing it to move relative to the first element 8 toward its second position in which its lower edge 94 moves away from the axis A2 and the arm 7 is thus gradually lengthened over the course of the movement of the cam 12 relative to the arm 7 (cf. FIGS. 10-11).

The rotational and lengthening movement of the telescoping arm 7 is stopped by the arrival of the stop 16 of the cam 12 in contact with the teeth 95 of its second element 9. In this position of the corkscrew 1, the cork 26 is completely removed from the neck 11. In other words, to completely remove the cork 26 from the neck 11, it will have sufficed for a user to screw the spiral 5 into said cork 26, then to exert a single pulling force on the maneuvering segment 4 of the handle 2 after having positioned the arm 7 bearing on the neck 11.

Once the cork 26 is removed from the neck 11, the user traditionally pulls the spiral 5 and returns the corkscrew 1 to its storage position, in which the spiral 5 and the arm 7 are folded against its lower edge.

Figure 15:
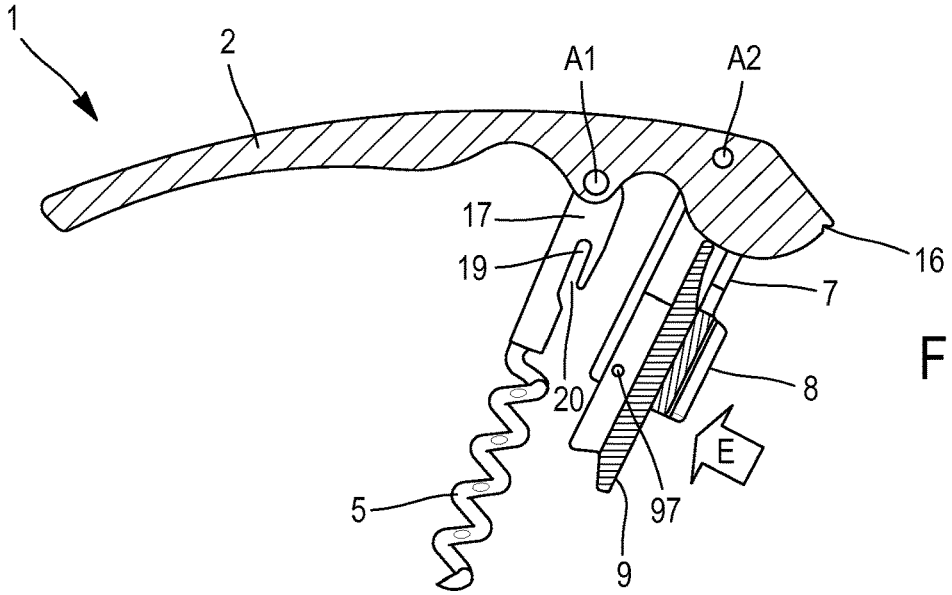
FIGS. 15 to 17 are sectional views of the corkscrew of FIG. 1 illustrating a first folding mode toward its storage position.
Figure 16:
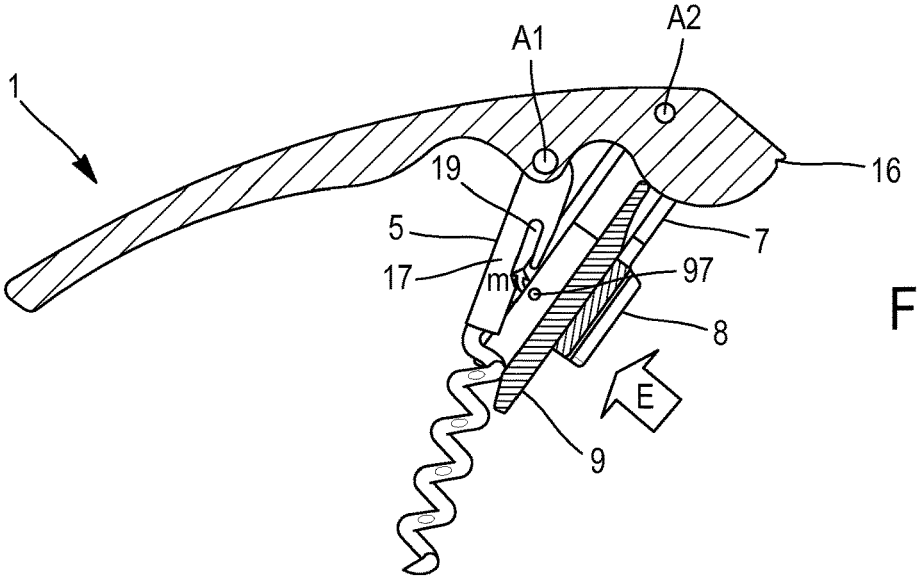
Figure 17:
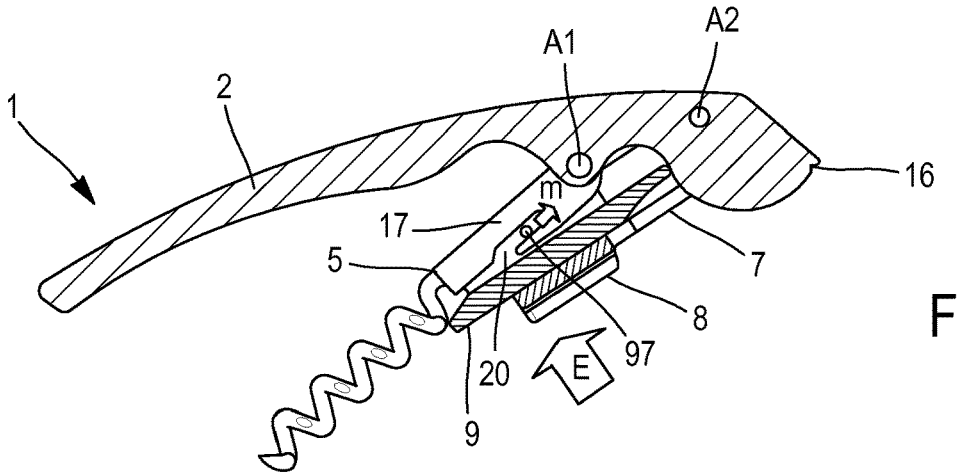
Figure 18:
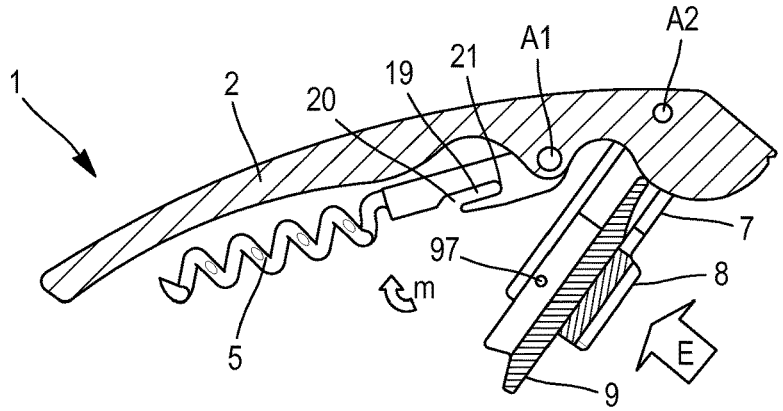
FIGS. 18 to 22 are sectional views of the corkscrew of FIG. 1 illustrating a second folding mode toward its storage position.
Figure 19:
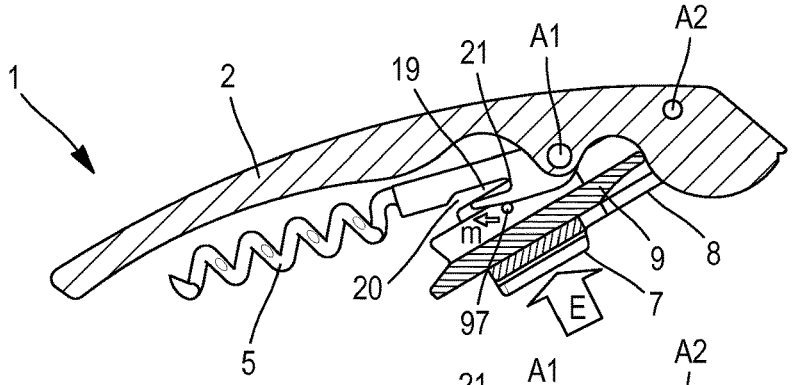
Figure 20:
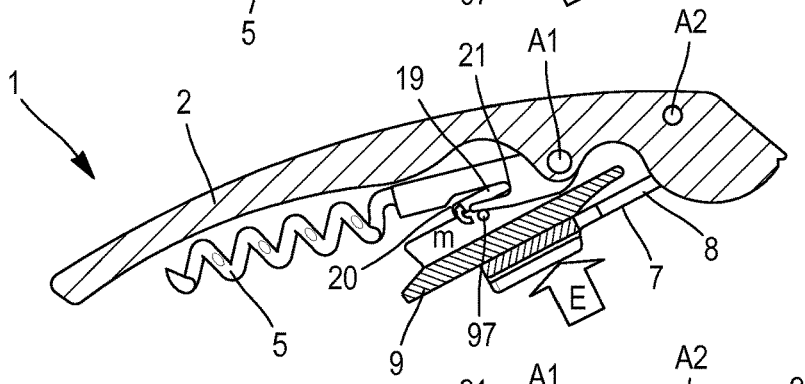
Figure 21:
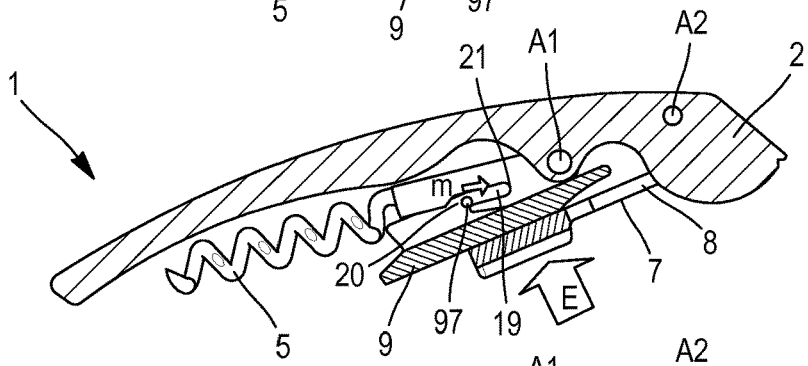
Figure 22:
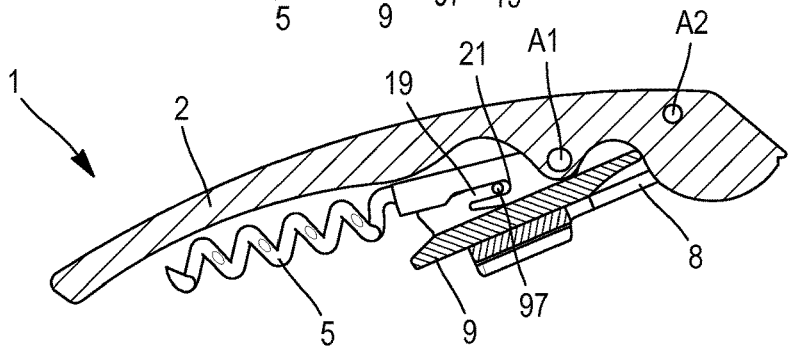

This last operation may be done in a single step, by concomitantly folding the spiral 5 and the arm 7, according to what is illustrated in FIGS. 15 to 17.

In this case, the user simply folds the telescoping arm 7, which comes into contact with the spiral 5, then causes it to rotate around the axis A1. The axis 97 of the arm 7, which is then placed below the inlet opening 20 of the groove 19, can then become housed directly inside the latter to next reach the bottom 21 thereof at the end of folding.

Naturally, the same operation can also be done in two steps by first folding the spiral 5, then the arm 7 (cf. FIGS. 18-22).

In this case, once the spiral 5 is folded, the axis 97 of the second part 9 of the arm 7 cannot be housed only directly in the groove 19 of the spiral 5, not being positioned appropriately across from the inlet opening 20 thereof. To achieve this, the user is forced to press the arm 7 against the spiral 5, which allows the axis 97 to come into contact with the oblique surface 24 extending between the upper zone 18*a* of the side wall 18 of the upper part 17 of the spiral 5 and the front wall 22 of the groove 19 (cf. FIG. 19). As the force is exerted by the user on the arm 7 toward the spiral 5, the second element 9 of the arm 7 moves along said oblique surface 24 and therefore relative to the first part 8 of the arm 7, causing the lengthening of the latter (cf. FIG. 20). In the location where the oblique surface 24 and the inlet opening 20 of the groove 19 meet, the axis 97 can be inserted into the groove 19 (cf. FIG. 21). Then, the second element 9 returns to its idle position, under the effect of the spring 10, fastened between the second element 9 of the arm 7 and the rotation axis A2, and allows the axis 97 to reach the bottom 21 of the groove 19 at the end of the folding (cf. FIG. 22).

I claim:

1. A corkscrew comprising:

a handle comprised of an end segment with an end edge and a maneuvering segment opposite said end segment, wherein said handle is comprised of an intermediate zone having a first axis, said intermediate zone being between said end segment and said maneuvering segment, said first axis being perpendicular to said handle, and wherein said end segment is comprised of a circular cam having a second axis centered on said circular cam, said second axis being perpendicular to said handle;

a spiral rotatably mounted at said first axis; and a telescoping arm being comprised of a first element having an upper part and a lower part opposite said upper part, and a second element having an upper end, a lower end opposite said upper end, and a lower edge at said lower end, wherein said first element is rotatably mounted rotating on said second axis, wherein said second element is in sliding engagement with said first element, wherein said second element has an idle position within said first element, said lower edge a first distance-from said second axis, wherein said second element has a usage position within said first element, said lower edge at a second distance from said second axis, said second distance being greater than said first distance from said second axis in said idle position, so as to bear said lower edge on a neck of a bottle, said second element being movable between said idle position and said usage position, wherein said upper end of said second element contacts said circular cam in said idle position and in said usage position, wherein a return member connects said upper end to said second axis, and wherein said lower end extends outward from said first element in said idle position and in said usage position.

2. The corkscrew, according to claim 1, wherein said circular cam comprises a first curve with a constant radius and a second curve with an increasing radius, said first curve being between said intermediate zone and said second curve, said second curve being between said first curve and said end edge.

3. The corkscrew, according to claim 2, wherein said circular cam further comprises a stop formed in an extension of said second curve.

4. The corkscrew, according to claim 1, wherein said return member is an extension spring.

5. The corkscrew, according to claim 1, wherein said second element is U-shaped and comprises two side wings bordering a bottom, wherein each side wing, has a V-shaped cutout so as to form said lower edge, and wherein said upper end of said second element is comprised of at least one tooth extending from said bottom and said side wings toward said circular cam, said at least one tooth contacting said circular cam.

6. The corkscrew, according to claim 5, wherein said second element comprises a notch formed in at least one side wing, said return member connecting to said notch and said second axis.

7. The corkscrew, according to claim 1, wherein said spiral comprises an upper part with a rectangular section connected to said first axis, and a side face oriented toward said telescoping arm, and wherein said upper part is comprised of a groove with a groove axis parallel to a longitudinal axis of said spiral, and an inlet opening formed in said side face.

8. The corkscrew, according to claim 7, wherein said groove is U-shaped and is comprised of a front wall, a rear wall, and a bottom between said front wall and said rear wall, wherein said front wall is connected to an upper zone of said side face by an oblique surface forming an angle smaller than 90° with said front wall.

9. The corkscrew, according to claim 7, wherein said rear wall of said groove is connected to a lower zone of said side face by another oblique surface forming an angle greater than 90° with said rear wall.

10. The corkscrew, according to claim 7, wherein said second element is U-shaped and comprises two side wings bordering a bottom, wherein each side wing has a V-shaped cutout so as to form said lower edge, wherein said upper end of said second element is comprised of at least one tooth extending from said bottom and said side wings toward said circular cam, said at least one tooth contacting said circular cam, and wherein said second element of said telescoping arm comprises a side axis extending between said two side wings.

* * * * *